US011279136B2

(12) United States Patent
Fischer et al.

(10) Patent No.: US 11,279,136 B2
(45) Date of Patent: Mar. 22, 2022

(54) DEVICE FOR SUPPLYING LIQUID INK TO AN INK PRINT HEAD IN AN INK PRINTING MACHINE

(71) Applicant: HEIDELBERGER DRUCKMASCHINEN AG, Heidelberg (DE)

(72) Inventors: Joerg-Achim Fischer, Laboe (DE); Michael Schoepke, Schwentinental (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/926,833

(22) Filed: Jul. 13, 2020

(65) Prior Publication Data

US 2021/0008889 A1 Jan. 14, 2021

(30) Foreign Application Priority Data

Jul. 11, 2019 (DE) ..... 102019118762

(51) Int. Cl.
*B41J 2/175* (2006.01)

(52) U.S. Cl.
CPC ..... *B41J 2/175* (2013.01)

(58) Field of Classification Search
CPC ..... B41J 2/175; B41J 2/18
USPC ..... 347/94
See application file for complete search history.

(56) References Cited

U.S. PATENT DOCUMENTS 8,235,482 B2 8/2012 Katada
9,840,083 B2 12/2017 Ratjen et al.
2003/0067511 A1* 4/2003 Okazawa ..... B41J 2/17596 347/68
2008/0079759 A1* 4/2008 Nagashima ..... B41J 2/175 347/10
2008/0198207 A1 8/2008 Katada
2012/0140006 A1 6/2012 Yunoki et al.

FOREIGN PATENT DOCUMENTS

DE 102016212733 A1 2/2017
EP 2574471 A1 4/2013

OTHER PUBLICATIONS

Domae, Yoshinori IJC 2 016 announcement https://theijc.com/home/expo-home/206-sii-printek-introduces-rc1536-ink-circulation-printhead (Year: 2016).*

* cited by examiner

*Primary Examiner* — Kristal Feggins
*Assistant Examiner* — Alexander D Shenderov
(74) *Attorney, Agent, or Firm* — Laurence A. Greenberg; Werner H. Sterner; Ralph E. Locher

(57) ABSTRACT

A device for supplying liquid ink to an ink print head in an ink printing machine includes an ink reservoir, a line for guiding the ink from the reservoir to the print head, a line for guiding the ink from the print head to the reservoir, and a damper for damping pressure fluctuations in the liquid ink. The damper has a movable and/or deformable membrane with a given thickness. In a position of repose, the membrane has a length L and a width W, and the length L is at least twice as long as the width W. The device renders possible in a simple and cost-efficient way to reliably avoid even large pressure fluctuations, in particular high pressure peaks in the liquid ink.

13 Claims, 4 Drawing Sheets

DEVICE FOR SUPPLYING LIQUID INK TO AN INK PRINT HEAD IN AN INK PRINTING MACHINE

CROSS-REFERENCE TO RELATED APPLICATION

This application claims the priority, under 35 U.S.C. § 119, of German patent application DE 10 2019 118 762, filed Jul. 11, 2019; the prior application is herewith incorporated by reference in its entirety.

BACKGROUND OF THE INVENTION

Field of the Invention

The invention relates to a device for supplying liquid ink to an ink print head in an ink printing machine. The device includes an ink reservoir, a line for guiding the ink between the reservoir and the print head, a line for guiding the ink between the print head and the reservoir, and a damper for damping pressure fluctuations in the liquid ink. The damper has a movable and/or deformable membrane.

The technical field of the invention is the field of the graphics industry and in particular the field of inkjet printing on an industrial scale, i.e. high-performance inkjet printing on flat substrates, i.e. the application of liquid ink to sheet-shaped or web-shaped printing substrates, preferably made of paper, paperboard, cardboard, plastic, or composite materials.

In the known DOD (drop-on-demand) ink printing processes for creating a printed image on a flat printing substrate, the application of liquid ink is achieved by an ink print head (in short: head) with individually controlled nozzles that generate tiny ink drops, preferably in a picoliter range, and transfer them to the printing substrate in a contact-free way and in accordance with the image to be printed.

Devices for a circulatory supply of liquid ink to the ink heads are known in the art. A disadvantage of such a device may be that when the ink printing machine is in operation, i.e. when the machine is printing and ink is being consumed, ink pressure fluctuations may be too high or there may be undesired ink pressure peaks, resulting in a loss of printing quality for the printed image and thus for the printed product. This problem may in particular occur in industrial inkjet printing machines, which include a plurality of print heads with a joint ink supply and consequently require a high volume flow of ink. When the print heads start to print, the volume flow increases and pressure in the liquid ink takes a sudden dip; when the print heads stop printing, the volume flow decreases and pressure in the liquid experiences a sudden increase. Furthermore, the volume flow fluctuates as a function of the image to be printed.

It has also become known to provide pressure dampers for the liquid ink. Commonly assigned U.S. Pat. No. 9,840,083 B2 and its counterpart German published patent application DE 10 2016 212 733 A1, for instance, disclose a method for damping pressure peaks in an ink line of an inkjet printer. The method uses two dampers: one in the supply line and one in the return line. Each of the dampers includes a membrane. The document does not provide any information on the shape of the membrane.

Another problem that may occur is that despite the use of dampers, the damping effect may be insufficient.

SUMMARY OF THE INVENTION

It is accordingly an object of the invention to provide a device for supplying a print head with liquid ink, which overcomes the above-mentioned and other disadvantages of the heretofore-known devices and methods of this general type and which provides for simple and cost-efficient means for preventing high pressure fluctuations, in particular high pressure peaks, in the liquid ink.

With the above and other objects in view there is provided, in accordance with the invention, a device for supplying liquid ink to an ink print head in an ink printing machine, the device comprising:

- an ink reservoir for liquid ink, a supply line for guiding the liquid ink between said ink reservoir and the print head, and a return line for guiding the liquid ink between the print head and said ink reservoir;
- a damper for damping pressure fluctuations in the liquid ink, the damper having a movable and/or deformable membrane;
- the membrane having a given thickness D and, in a position of rest, the membrane having a length L and a width W, with the length L being at least twice as long as the width W.

In other words, the objects are achieved, in accordance with the invention, with a device for supplying liquid ink to an ink print head in an ink printing machine comprising an ink reservoir, a line for conducting the ink from the reservoir to the print head, a line for conducting the ink from the print head to the reservoir, and a damper for damping pressure fluctuations in the liquid ink. The damper has a movable and/or deformable membrane with a given thickness and, when it is at rest, i.e., in a position of repose, the membrane has a length L and a width W and the length L is at least twice as long as the width W.

The invention advantageously provides a simple and cost-efficient way reliably to prevent high pressure fluctuations in the liquid ink, in particular high pressure peaks.

The membrane advantageously forms a hydraulic capacity of sufficient magnitude to deal with the expected volume changes/volume flow changes of the liquid ink at least in the region of the print heads and manifolds. To achieve this aim by simple means, the invention proposes to select a length L of the membrane that equals twice the width W at the minimum, i.e. in other words, the membrane has an elongated shape. This shape is particularly advantageous if the manifolds are likewise of elongated shape. In such a case, the length of the manifolds may advantageously be used to accommodate the membrane and thus to attain a hydraulic capacity of sufficient magnitude. Even when high pressure fluctuations or high pressure peaks occur during printing, the dynamic stroke of the membrane about the operating point is advantageously small, ensuring that the membrane is not put under too much stress; for instance, the dynamic stroke is smaller than n times the thickness D, with $n<5$ or $n<10$. In contrast, the static stroke at the operating point may be greater; here, n may be approximately 50. Additional elongated elements that would waste installation space are no longer required.

The membrane is preferably integrated into a manifold or a section or a part of the manifold. Every one of the two manifolds may have a membrane.

Further, the membrane is preferably disposed close to the print heads in the ink circulation system. In particular, the membrane is preferably disposed immediately upstream and/or immediately downstream of the print heads.

The membrane is a passive-action hydraulic capacity. Therefore, the membranes do not need an electronic (potentially closed-loop) control and/or drives, and consequently costs are low. In addition, the membrane does not require any maintenance.

The membrane provides a quick balancing movement at very low forces (like a soft, pre-loaded spring).

The membrane may comprise a stop or two stops to limit its movement (in one or two directions). The stops, in particular on the side facing the ink, may be designed as grids.

There is preferably no air between the membrane and the ink. The membrane has a slight inclination to provide easy deaeration.

In accordance with a preferred further feature of the invention the membrane comprises a plate embodied as a metal or stainless steel plate. Such a material provides the required elastic properties of the membrane.

In accordance with an added feature of the invention, the plate has a built-in shape, in particular an embossed or stamped shape, in particular a (cross-sectional) wave shape. The shape advantageously acts to create sufficient reset forces. The dimensions of the waves (or corrugations) are preferably such that a required and predefined spring rate is achieved. The preferred material is an embossed metal foil of a thickness D of between 50 and 200 μm.

The spring rate is a function of the number of waves, the shape of the waves (sinusoidal, rectangular, etc.), the wave height, the material (Young's modulus), the length L, the width W, and thickness D. Up to the operating point (and a little beyond), the spring rate preferably behaves in a linear way.

A preferred further development of the invention may be characterized in that the embossed shape forms a bellows or multiple bellows in a row or in a two-dimensional arrangement.

In accordance with a further feature of the invention, the membrane is designed as a cover, bottom, or wall or as a section or element of a cover, bottom, or wall that is a part of the ink reservoir, of an ink line, or of an ink manifold. In this way, i.e. due to the proximity of the membrane and the manifold, the membrane as a hydraulic capacity is coupled to the manifold in an optimum way, i.e. no undesired hydraulic resistance is created. The membrane may also be any desired combination of cover, wall, and/or bottom. It is possible to provide multiple covers, walls, and/or bottoms as a membrane.

In accordance with a preferred further development of the invention, the damper is disposed in an ink circulation system comprising at least the reservoir, the lines, the manifolds, and a pump, with the print heads connected to the ink circulation system or integrated into the ink circulation system, and in that the damper is essentially disposed in the immediate vicinity of the print heads or on the element that is closest to the print heads in the ink circulation system.

In accordance with again a further feature of the invention, when it is in its rest position, the shape A of the membrane is not a circular or quadrangular shape, but in particular a rounded rectangular shape (rectangle with two semicircles) or an elliptic shape.

In accordance with an added feature of the invention, the thickness D is a tenth or a hundredth or a thousandth of the width W at the maximum.

In accordance with another preferred development of the invention the membrane is attached to a carrier via spring elements in a way for the membrane to be movable and/or deformable.

A preferred further development of the invention is that the carrier and the spring elements are manufactured as a single component in an additive process or in a 3D printing process.

Other features which are considered as characteristic for the invention are set forth in the appended claims.

Although the invention is illustrated and described herein as embodied in a device for supplying liquid ink to an ink print head in an ink printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
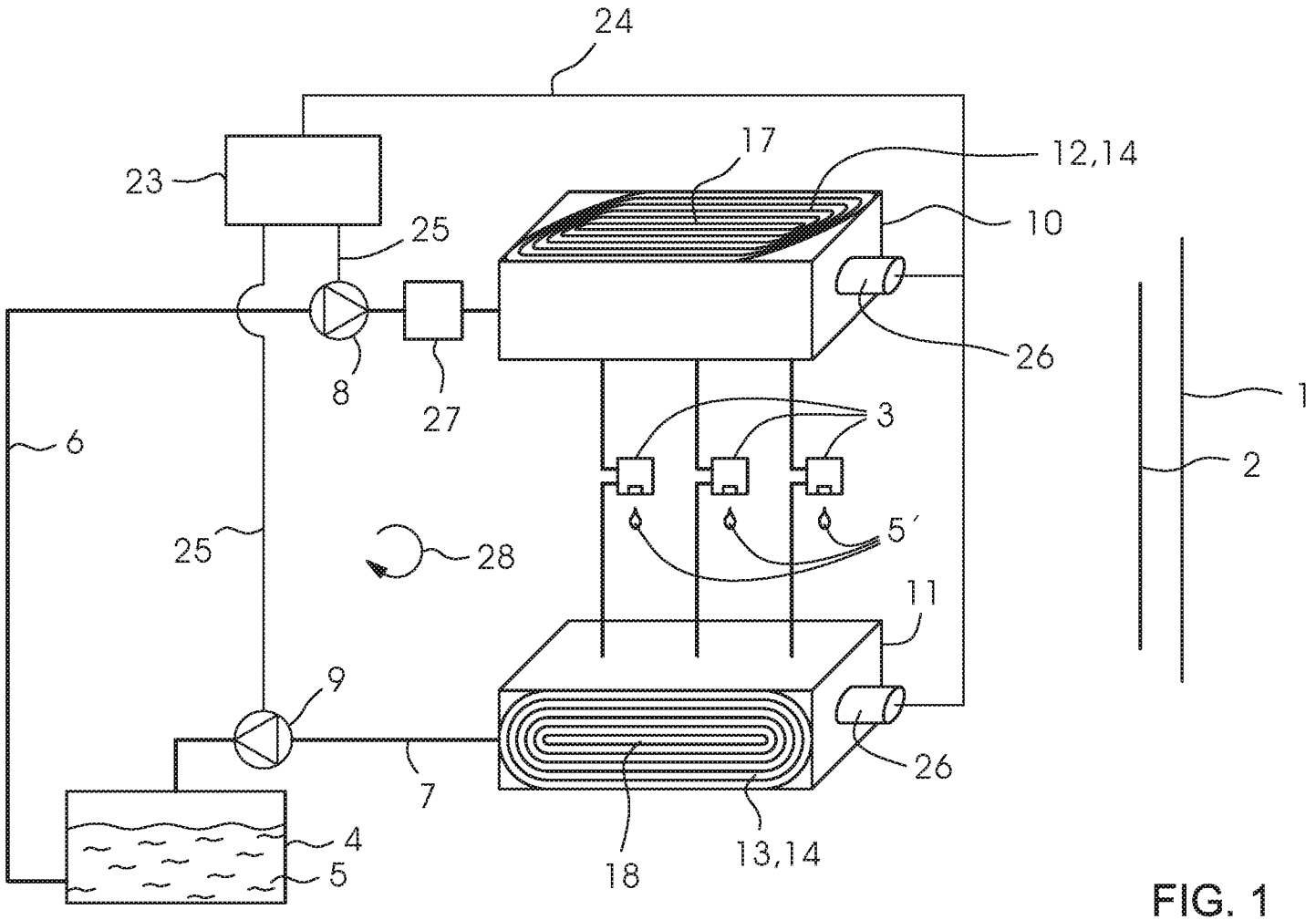
FIG. 1 is a partly schematic view a device according to the invention.

Referring now to the figures of the drawing in detail and first, particularly, to FIG. 1 thereof, there is shown a preferred embodiment of a device of the invention. An ink printing machine 1, for instance for the industrial production of printed products made of sheets or webs, comprises an ink supply device 2. The figure shows a plurality of ink print heads 3 connected to a reservoir 4 and supplied with ink 5 from the reservoir. The print heads are actuated, or driven, in accordance with the image. They generate corresponding ink droplets 5' and transfer them to the printing substrate to create the printed image.

FIG. 1 illustrates an ink line 6, which is also referred to as the feed line 6, that guides ink from the reservoir 4 to the print heads 3. In addition, the figures show an ink line 7, also referred to as the return line 7, in which unused ink is guided back to the reservoir 4. A feed line pump 8 is integrated into the feed line 6. A return line pump 9 is integrated into the return line 7. Alternatively, only one pump may be provided in the device 2.

In addition, FIG. 1 shows two sensors 26 for measuring a pressure in the liquid ink. Signal and/or data lines 24 connect the sensors 26 to a computer, which is in turn connected to the pumps 8 and 9 via signal and/or data lines 25. This is a way to provide closed-loop control of the pressure in the liquid, for instance by a target value/actual value comparison.

At the end of the feed line 6 and close to the print heads 3, there is provided a so-called feed line ink manifold. In a corresponding way, a return line ink manifold 11 is provided close to the print heads 3 at the beginning of the return line 7. The manifolds are preferably disposed on different levels, thus defining the static pressure in the print heads/at the nozzles thereof (also referred to as the meniscus pressure). During printing, a dynamic pressure is added to the static pressure.

The two manifolds comprise branches of the ink line. The number of branches preferably corresponds to the number of ink heads. The print heads 3 are connected to the two manifolds 10 and 11 by respective ink feed and return lines. Unused ink returns to the reservoir 4, which means that the device 2 is a device for a circulatory supply of ink including an ink circulation system 28.

In FIG. 1, by way of example, the two manifolds are schematically shown as rectangular elements. The manifolds may likewise be designed as tubes, for instance.

In the illustrated example, the feed line manifold 10 comprises a damper 12 and the return line manifold 11 comprises a damper 13. Both dampers are provided to reduce or even eliminate undesired pressure fluctuations and in particular undesired or even damaging pressure peaks in the liquid ink, i.e. in the ink circulation system 28. As an alternative to the illustrated embodiment, it is possible to equip only one of the two manifolds, preferably the feed line manifold 10, with a damper.

Each one of the dampers 12 and 13 is embodied as a movable and/or deformable membrane 14, which are shown in more detail in the following figures. At the feed line manifold 10, the membrane 12 is shown by way of example as a cover 17 (or ceiling or top side) of the manifold or integrated into the cover 17 of the manifold. At the return line manifold 11, the membrane 13 is shown by way of example as a wall 18 of the manifold or integrated into a (side) wall 18 of the manifold. Alternatively, the membranes 12, 13, or 14 may form the bottom (lower side) of the manifold. As a further alternative, the membranes 12, 13, 14 may form wall sections or wall elements of a tube (if the manifolds 10, 11 are tube-shaped).

FIG. 1 also shows that further components 27, preferably filters and/or deaeration devices, may be provided in the line 6 that leads to the feed line manifold 10.

Figure 2:
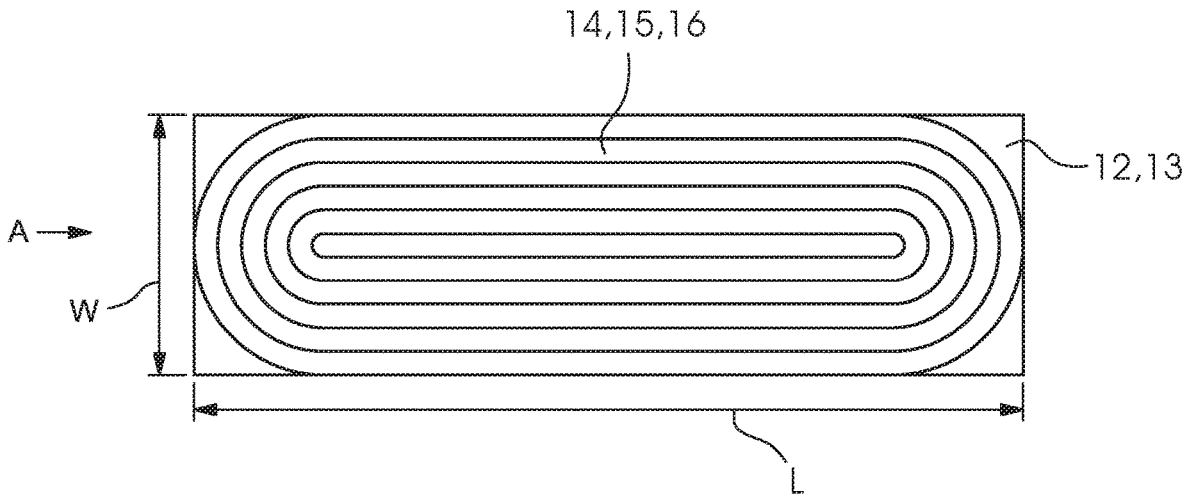
FIG. 2 illustrates a detail of a device of the invention.

FIG. 2 illustrate a preferred membrane 14 having a surface A. The membrane may for instance be embodied as a metal plate or as a stainless steel plate or, alternatively, as a foil, for instance a metal or plastic foil. A shape 15 may be formed into, in particular embossed or stamped into, the membrane. Alternatively, the shape may be created when the membrane is manufactured. The shape preferably forms a bellows 16, i.e. its cross-section has waves or is undulated.

In FIG. 2, the bellows has a special shape: each end of the bellows is semicircular (semicircular bellows elements), and between the ends, the bellows has long straight bellows elements.

FIG. 2 shows that at rest, the membrane has a length L and a width W, the length L being at least twice as long as the width W. In other words, the membrane or the bellows has an elongated shape.

Figure 3A:
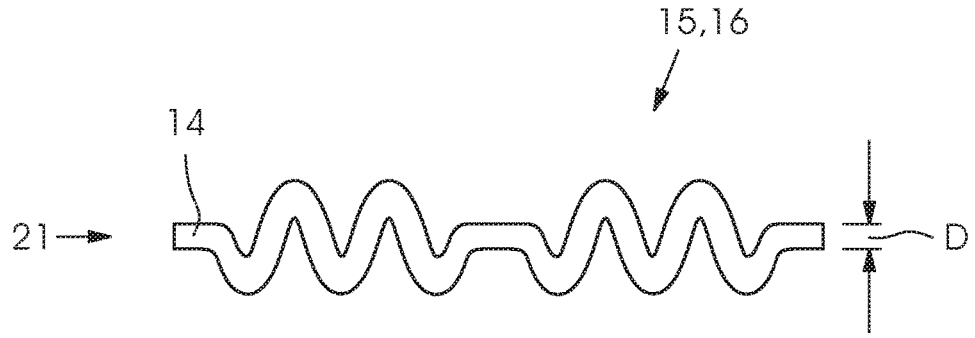
FIGS. 3A and 3B are cross-sectional views of the detail of the device of the invention.
Figure 3B:
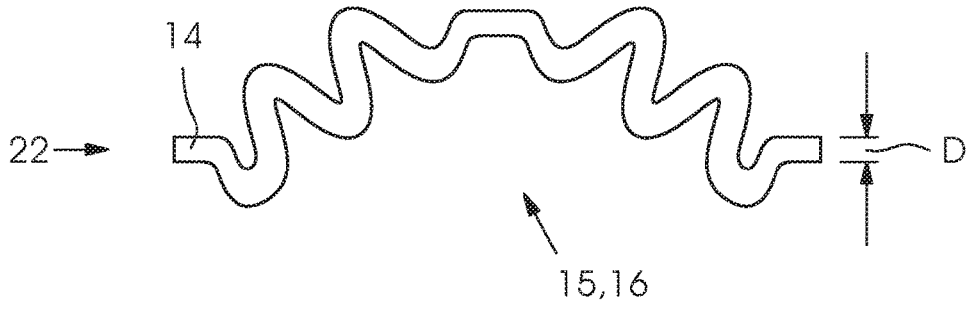

FIGS. 3A and 3B are cross-sectional views of the preferred membrane 14 of FIG. 2. In FIG. 3A, the membrane 14 is shown at rest (at predefined normal pressure). In FIG. 3B, the membrane is shown in its shifted or deformed state (for instance due to high pressure caused by a pressure peak). The shifting of the membrane is made possible by the bellows 16, i.e. the bellows structure thereof. In addition, FIGS. 3A and 3B show the thickness D of the membrane.

Figure 4:
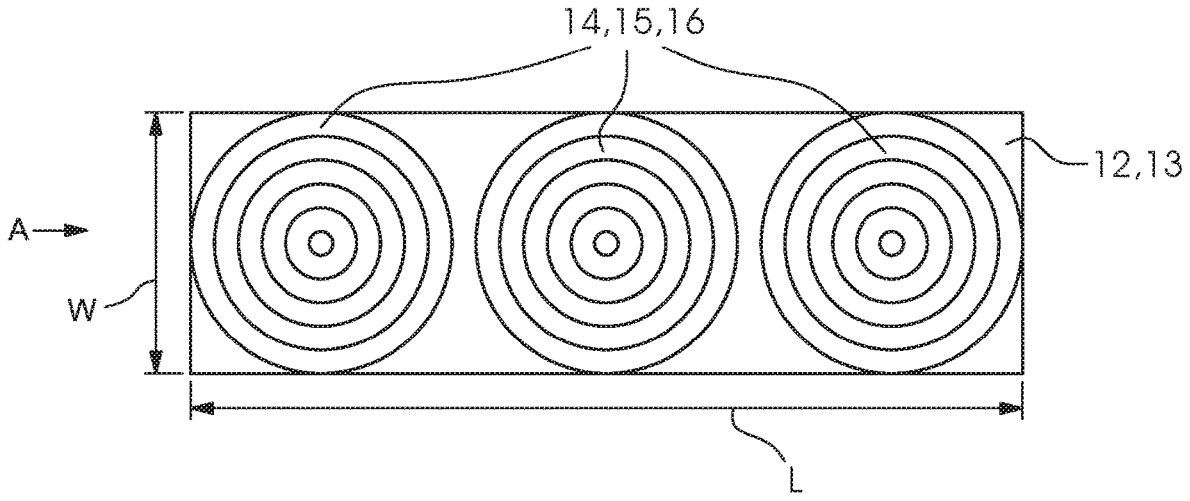
FIG. 4 illustrates a further detail of a device of the invention.

The following is a concrete example of the embodiment illustrated in FIGS. 2, 3A, and 3B:

operating point (meniscus pressure) at a pressure of −62 mbar
length L: approximately 100 cm
width W: approximately 35 cm
area A: approximately 350 $cm^2$
force at the operating point: approximately 217 N
spring rate of the material: approximately 35.000 $N/m^2$
shift (at the operating point): approximately 6.2 mm
dynamic stroke of the membrane: approximately 0.1 mm
membrane embossment: 0.4 waves/cm
wave height of the membrane (amplitude of the embossed waves): 1 mm FIG. 4 illustrates a further preferred membrane 14 having a surface area A. The membrane may likewise be designed as a metal plate or a stainless steel plate or, alternatively, as a foil, for instance a metal or plastic foil. The membrane may be formed to have a shape 15, in particular an embossed shape. Alternatively, the shape may be formed when the membrane is manufactured. The shape preferably includes multiple bellows 16 or a row of n bellows (n>1). Alternatively, a two-dimensional arrangement of n times m bellows 16 may be provided (n and m>1).

In FIG. 4, the bellows has a special shape: the bellows 16 comprises multiple bellows, in particular bellows disposed adjacent to one another (in a plane). The individual bellows may have concentric waves.

FIG. 4 shows that at rest, the membrane has a length L and a width W, the length L being at least twice as long as the width W. In other words, the membrane or bellows or arrangement of multiple bellows in a row/a two-dimensional arrangement has an elongated shape.

Figure 5A:
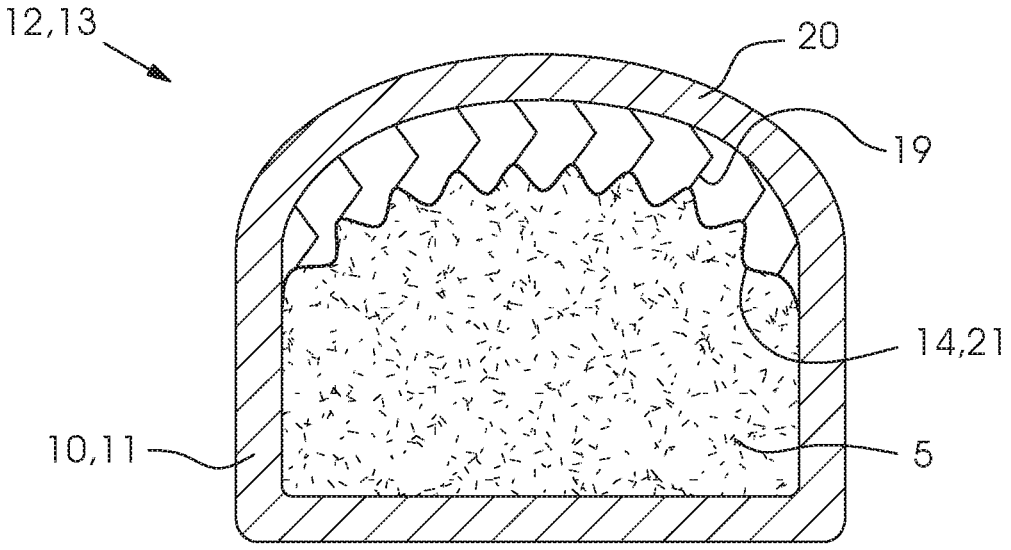
FIGS. 5A and 5B illustrate a further device of the invention.
Figure 5B:
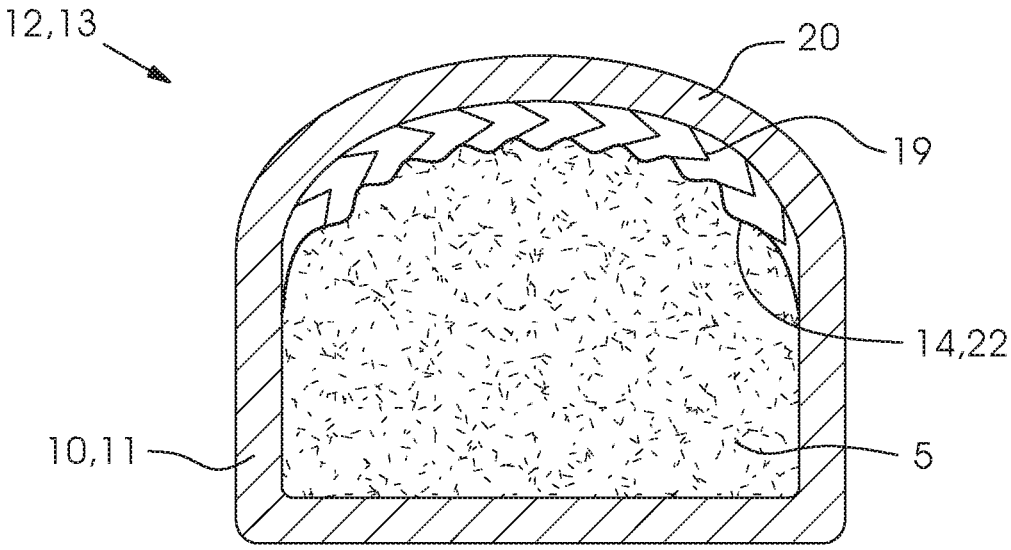

FIGS. 5A and 5B illustrate a further embodiment of the invention. The membrane 14 is attached to a carrier 20 via spring elements 19 in a way for the membrane 14 to be movable and/or deformable. The carrier and the spring elements are manufactured as a single component in an additive or a 3D printing process. The material may be metal or plastic. FIG. 5A illustrates the membrane 14 in its rest position 21; FIG. 5B in the shifted position in which the spring elements have been deformed, for instance bent.

The following is a summary list of reference numerals and symbols, and the corresponding structure used in the above description of the invention:

1 ink printing machine
2 ink supply device
3 print heads
4 reservoir
5 ink
5 ink drops
6 ink line (feed line)
7 ink line (return line)
8 ink pump (feed line)
9 ink pump (return line)
10 ink manifold (feed line)
11 ink manifold (return line)
12 ink pressure damper (feed line)
13 ink pressure damper (return line)
14 membrane, e.g. plate or foil
15 embossed shape
16 bellows
17 cover or bottom
18 wall
19 spring elements
20 spring elements carrier
21 rest position of the membrane
22 shifted position of the membrane
23 computer
24 signal or data line
25 signal or data line
26 sensors
27 further components, e.g. filters or deaeration devices
28 circulation system
A area of the membrane D thickness of the membrane
L length of the membrane
W width of the membrane

The invention claimed is:

1. A device for supplying liquid ink to an ink print head in an ink printing machine, the device comprising:

an ink reservoir for liquid ink, a supply line for guiding the liquid ink between said ink reservoir and the print head, and a return line for guiding the liquid ink between the print head and said ink reservoir;

a damper for damping pressure fluctuations in the liquid ink, said damper having a movable and/or deformable membrane;

said membrane having a given thickness and, in a position of rest, said membrane having a length and a width, with the length being at least twice as long as the width.

2. The device according to claim 1, wherein said membrane comprises a metal plate.

3. The device according to claim 1, wherein said membrane comprises a stainless steel plate.

4. The device according to claim 1, wherein said membrane is a plate having an embossed shape.

5. The device according to claim 4, wherein the embossed shape forms a bellows, or a row arrangement of multiple bellows, or a two-dimensional arrangement of multiple bellows.

6. The device according to claim 1, wherein said damper is disposed in an ink circulation system comprising at least said reservoir, said feed and return lines, said manifolds, and a pump, wherein the print head, or a plurality of print heads are connected to said ink circulation system or integrated into said ink circulation system, and wherein said damper is disposed substantially in an immediate vicinity of said print heads or on an element of said ink circulation system closest to the print heads.

7. The device according to claim 1, wherein in the position of rest, the surface area of the membrane does not have a circular or quadrangular shape.

8. The device according to claim 1, wherein the thickness is no more than a tenth of the width.

9. The device according to claim 1, wherein the thickness is no more than a hundredth of the width.

10. The device according to claim 1, wherein the thickness is no more than a thousandth of the width.

11. A device for supplying liquid ink to an ink print head in an ink printing machine, the device comprising:

an ink reservoir for liquid ink, a supply line for guiding the liquid ink between said ink reservoir and the print head, and a return line for guiding the liquid ink between the print head and said ink reservoir;

a damper for damping pressure fluctuations in the liquid ink, said damper having a movable and/or deformable membrane; said membrane having a given thickness and, in a position of rest, said membrane having a length and a width, with the length being at least twice as long as the width, said membrane embodied as an element selected from the group consisting of a cover, a bottom, a wall, a part of a cover, a part of a bottom, and a part of a wall, and said element defining a part of said reservoir, of said supply line, of said return line, or of a manifold for the ink.

12. A device for supplying liquid ink to an ink print head in an ink printing machine, the device comprising:

an ink reservoir for liquid ink, a supply line for guiding the liquid ink between said ink reservoir and the print head, and a return line for guiding the liquid ink between the print head and said ink reservoir;

a damper for damping pressure fluctuations in the liquid ink, said damper having a movable and/or deformable membrane; said membrane having a given thickness and, in a position of rest, said membrane having a length and a width, with the length being at least twice as long as the width; and a carrier for supporting said membrane and spring elements movably and/or deformably attaching said membrane to said carrier.

13. The device according to claim 12, wherein said carrier and said spring elements are manufactured as a single component in an additive process or in a 3D printing process.

* * * * *